US005688328A

United States Patent [19]

Tong et al.

[11] Patent Number: 5,688,328

[45] Date of Patent: Nov. 18, 1997

[54] APPARATUS FOR IMPROVED COATING OF A CRT DISPLAY SCREEN

[75] Inventors: Hua-Sou Tong, Arlington Heights, Ill.; Chun-Min Hu, Keelung, Taiwan

[73] Assignee: Chunghwa Picture Tubes, Ltd., Taoyuan, Taiwan

[21] Appl. No.: 527,420

[22] Filed: Sep. 13, 1995

[51] Int. Cl.[6] ..... B05C 11/11

[52] U.S. Cl. ..... 118/505; 118/500; 118/52; 118/319; 269/908

[58] Field of Search ..... 118/319, 320, 118/500, 504, 52, 505; 313/478, 479; 269/908

[56] References Cited

U.S. PATENT DOCUMENTS

| | | | |
|---|---|---|---|
| 4,695,045 | 9/1987 | Chase et al. | 269/152 |
| 4,930,015 | 5/1990 | Dougherty et al. | 358/246 |
| 5,489,369 | 2/1996 | Bjornard et al. | 118/504 |

*Primary Examiner*—Donald E. Czaja
*Assistant Examiner*—Calvin Padgett
*Attorney, Agent, or Firm*—Emrich & Dithmar

[57] ABSTRACT

Apparatus for applying an antistatic and/or antireflective coating to the outer surface of a curved glass display screen of a cathode ray tube (CRT) includes a spin coating arrangement for rotating the CRT about its longitudinal axis after the coating solution is deposited on a center portion of the display screen. Centrifugal force and gravity urge the coating solution outwardly toward the edges of the display screen in forming a thin layer of uniform thickness on the display screen. A curved shield shaped in accordance with the display screen's curvature is disposed above the display screen in closely spaced relation thereto to form a chamber of stable air above the display screen and eliminate air turbulence and its tendency to spread the coating nonuniformly. The curved shield may include a center aperture for permitting the coating solution to be deposited upon the display screen prior to rotation and is adapted for easy attachment to and removal from the CRT's peripheral implosion protection band.

6 Claims, 2 Drawing Sheets

APPARATUS FOR IMPROVED COATING OF A CRT DISPLAY SCREEN

FIELD OF THE INVENTION

This invention relates generally to the application of an antistatic and/or antireflective coating to the outer surface of the display screen of a cathode ray tube (CRT) and is particularly directed to the application of an antistatic and/or antireflective coating of highly uniform thickness to the outer surface of a curved display screen of a CRT.

BACKGROUND OF THE INVENTION

Current color display terminals typically incorporate a high resolution CRT having an antistatic and antireflective coating on the outer surface of its display screen, or glass faceplate. The most economical and practical method of applying the antistatic and antireflective coating is by means of liquid spin coating, where the antistatic coating and antireflective coating are deposited on a center portion of the display screen and the display screen is rotated causing the coating to move outwardly and cover the entire display screen. One of the problem encountered in this coating approach is caused by air turbulence above the rotating CRT display screen which results in a nonuniform coating thickness. A nonuniformity in coating thickness gives rise to a change in the wavelength, i.e., the color, of the light passing through the coating by a factor of four because of internal reflection of ambient light by the glass display screen.

For the case of flat glass display screens, attempts have been made to minimize the impact of air turbulence on the application of the coating to the display screen by positioning a flat shield above the rotating flat glass display screen. Referring to FIG. 1, there is shown a simplified schematic diagram of a prior art arrangement shown partially in section of a spin coating apparatus 10 for applying an antistatic and/or antireflective coating to the outer surface of a flat glass display screen 20. The spin coating apparatus 10 includes a positioning/support mechanism 12 coupled to and rotationally displaced in the direction of arrow 34 by means of a rotary drive unit 36. The spin coating apparatus 10 further includes a plurality of support blocks 14 and 16 engaging a supporting member 18 disposed therebetween. Positioned on support member 18 is the flat glass display screen 20. Display screen 20 is securely maintained in position on the upper surface of support member 18 by conventional means such as a clamp or a retaining member disposed about the display screen (neither of which are shown in the figure for simplicity).

Disposed immediately above the flat glass display screen 20 in a closely spaced manner is a flat shield 22. Shield 22 is coupled to and supported by a plurality of support rods 26 and 28. Additional support rods 27 and 29 engaging shield 22 are shown in the top plan view of FIG. 2 of a portion of the spin coating apparatus shown in FIG. 1. The flat display screen 20 and shield 22 (which are shown in FIG. 2 in dotted line form) are respectively generally rectangular and circular in shape. With the shield 22 securely coupled to the positioning/support mechanism 12 of the spin coating apparatus 10, shield rotates with the positioning/support mechanism as well as with the glass display screen disposed thereon. While shield 22 as shown is supported by a plurality of spaced rods, shield 22 may equally as well be positioned upon and supported by a generally circular structure having a plurality of teeth which are disposed upon and engage positioning/support mechanism 12. Disposed above the shield 22 is a generally circular cover 24 which includes a center cap 32. Center cap 32 engages an upper end of a center support/discharge rod 30 which is inserted through an aperture in the center of shield 22. With the covers cap 32 engaging the upper end of the center support/discharge rod 30, cover 24 is securely maintained in position in spaced relation above shield 22. A solution of an antistatic and/or antireflective coating is inserted through the center support/discharge rod 30 onto a center portion of the upper surface of the glass display screen 20 just prior to rotation of the display screen. When the display screen 20 is rotated, the antistatic and/or antireflective coating spreads outwardly over the entire surface of the display screen. While the spin coating apparatus 10 of FIG. 1 operates reasonably well with a flat display screen 20, it has not been shown to be effective in applying a coating of uniform thickness to the outer surface of a curved glass display screen as employed in most conventional CRT's.

The present invention addresses the aforementioned limitations of the prior art by providing apparatus for improved coating of the curved glass display screen of a CRT which employs a curved shield having substantially the same curvature as the display screen and which is disposed in a closely spaced manner above the display screen during rotation to eliminate air turbulence above the screen and provide a thin coating of substantially uniform thickness on the curved display screen. The shield is easily and quickly attached to the display screen and removed therefrom by means of the display screen's implosion protection band as described below.

OBJECTS AND SUMMARY OF THE INVENTION

Accordingly, it is an object of the present invention to provide an outer layer of an antistatic and/or antireflective coating of substantially uniform thickness to the outer surface of a curvilinear CRT display screen.

It is yet another object of the present invention to eliminate air turbulence above the glass display screen of a CRT as the display screen is being coated with an antistatic and/or antireflective layer to provide a layer of the coating of substantially uniform thickness for the presentation of a high resolution video images.

A further object of the present invention is to provide a shield arrangement which is easily and quickly attached to and removed from a CRT during manufacture and which substantially eliminates air turbulence during the application of an antistatic and/or antireflective coating to the CRTs glass display screen to ensure uniform coating thickness.

This invention contemplates apparatus for applying an antistatic and/or antireflective coating of uniform thickness to the outer surface of a curvilinear glass display screen of a CRT, the CRT including an implosion protection band disposed about the periphery thereof, the apparatus comprising: a rotary support arrangement for engaging and rotationally displacing the CRT about its longitudinal axis with the display screen directed upwardly; a curvilinear shield having a larger surface area than the display screen and substantially the same curvature as the display screen; and and a mounting structure for attaching the shield to the CRTs implosion protection band and maintaining the shield in closely spaced relation to and above the display screen to avoid air turbulence above the display screen as the CRT is rotationally displaced for forming the coating with a substantially uniform thickness.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
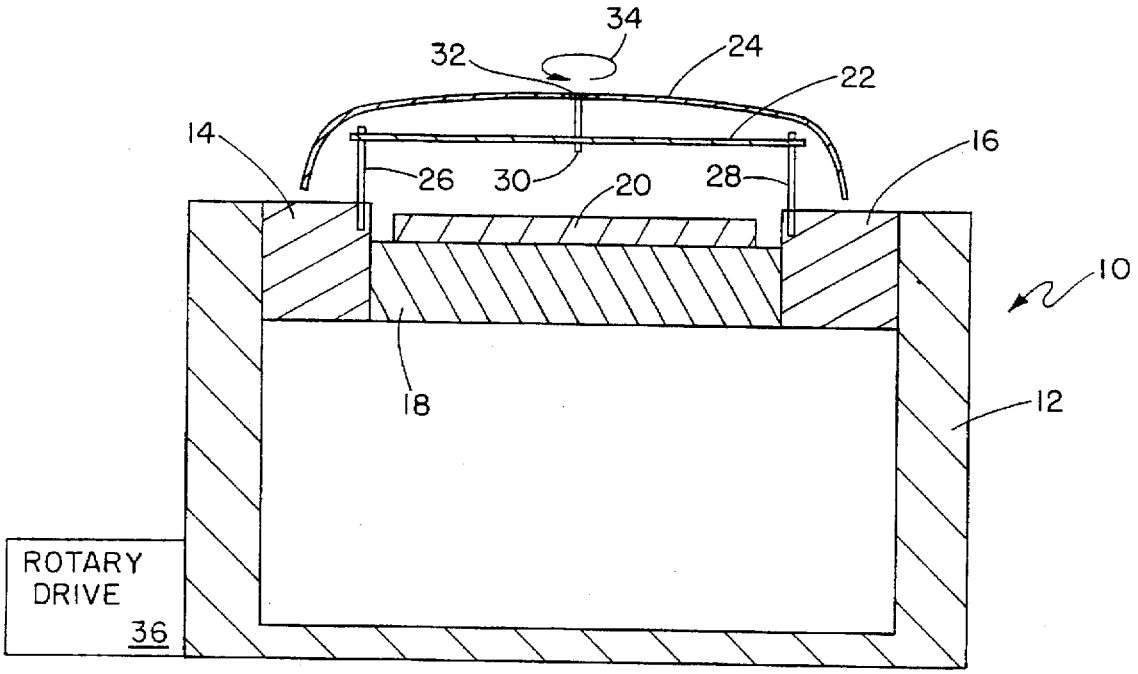
FIG. 1 (PRIOR ART)
FIG. 1 is a simplified schematic illustration of a prior art spin coating apparatus shown partially in block diagram form and partially in cross section for applying an antistatic and/or antireflective coating to the outer surface of a flat glass display screen.
Figure 2:
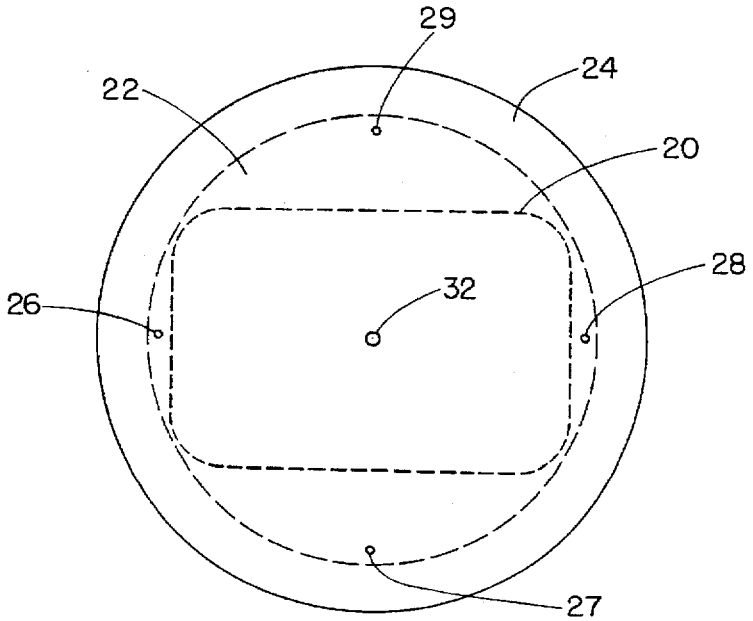
FIG. 2 (PRIOR ART)
FIG. 2 is a partial top plan view of the spin coating apparatus of FIG. 1 showing the flat glass display screen, an upper cover and a flat shield disposed therebetween.
Figure 3:
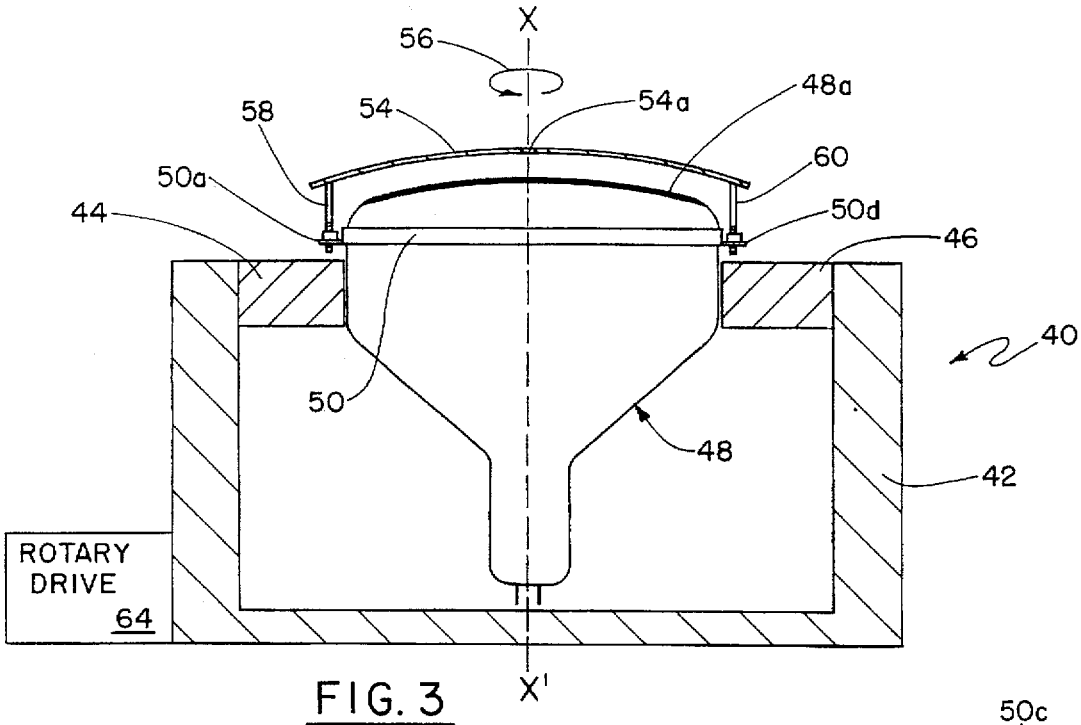
FIG. 3 is a simplified schematic illustration shown partially in block diagram form and partially in cross section of a spin coating apparatus in accordance with the present invention for applying an antistatic and/or antireflective coating to the outer surface of a curved glass display screen of a CRT.

Referring to FIG. 3, there is shown a simplified schematic illustration shown partially in block diagram form and partially in cross section of a spin coating apparatus 40 in accordance with the principles of the present invention. As in the prior art embodiment, the spin coating apparatus 40 includes a positioning/support mechanism 42 which is coupled to and rotationally displaced in the direction of arrow 56 by means of a rotary drive unit 64. Positioning/support mechanism 42 includes a plurality of support blocks 44 and 46 disposed about a CRT 48 for engaging a lateral portion of the CRT and maintaining it securely in position within the positioning/support mechanism. CRT 48 is rotationally displaced about its longitudinal axis X–X'. CRT 48 includes a glass envelope having a curved display screen, or display screen, 48*a* on a forward end portion thereof.

Figure 5:
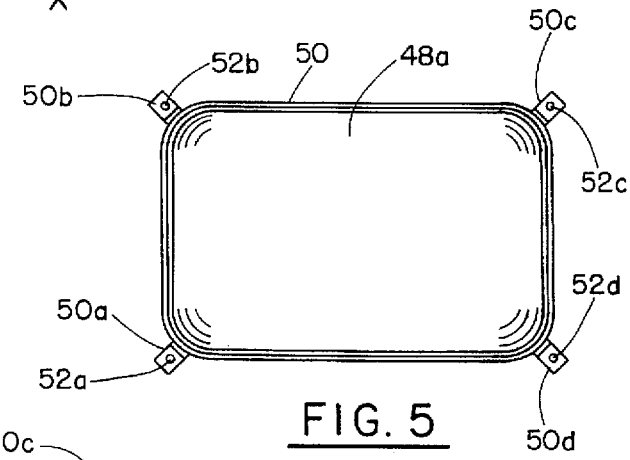
FIG. 5 is a plan view of the curved glass display screen of a CRT showing the CRTs peripheral implosion protection band.
Figure 6:
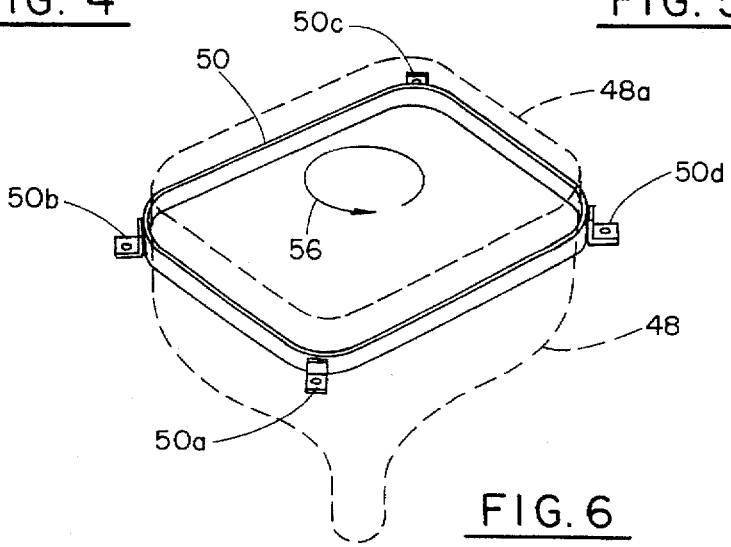
FIG. 6 is a perspective view shown partially in phantom of an implosion protection band disposed about a CRT with a curved glass display screen.

As shown in FIG. 3, as well as in the plan view of FIG. 5 and the perspective view of FIG. 6, disposed about and engaging a lateral portion of the CRT 48 is an implosion protection band 50. Implosion protection band 50 is typically comprised of a high strength metal and is in the form of a thin closed strip attached under tension around the side wall of the CRTs glass envelope. Implosion protection band 50 applies a compressive force which redistributes the stresses on the CRT's display screen so that in the event of a mechanical failure, the glass envelope will crack allowing air to enter the glass envelope, thus preventing its shattering and the outward projection of glass shards. The implosion protection band 50 is typically secured to the outer periphery of the CRT's glass envelope either by means of a metal crimp or by welding.

Figure 4:
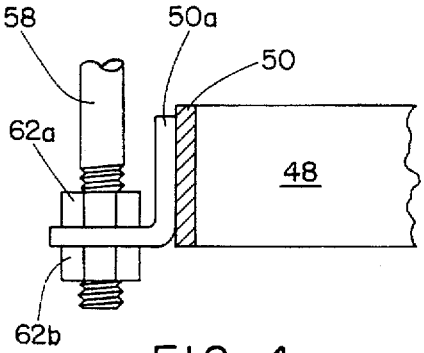
FIG. 4 is a side elevation view showing partially in section of a corner of a curved glass display screen and the manner in which a curved shield is attached to the CRT's implosion protection band in accordance with on aspect of the present invention.

Attached to an outer portion of the implosion protection band 50 adjacent each of its four comers are four band ears, or tabs, 50*a*, 50*b*, 50*c*, and 50*d*. Each of the band ears 50*a*, 50*b*, 50*c* and 50*d* includes a respective aperture 52*a*, 52*b*, 52*c* and 52*d* therein. Details of the manner in which the band ears are attached to the implosion protection band 50 is shown in the side elevation view of FIG. 4 for the first band ear 50*a*. Each band ear is generally L-shaped and is securely attached to an outer, lateral portion of the band 50 by conventional means such as a weldment. The aperture within band ear 50*a* is adapted to receive a support rod 58 having a threaded end portion. Threadably engaging support rod 58 and disposed on respective sides of band ear 50*a* are first and second nuts 62*a* and 62*b*. With the first and second nuts 62*a*, 62*b* tightened so as to securely engage band ear 50*a*, support rod 58 is securely attached to the implosion protection band 50 via the band ear. As shown in this side elevation view of the CRT 48 of FIG. 3, first and second support rods 58, 60 are attached to respective comers of the implosion protection band 50 via respective band ears 50*a* and 50*d*. Two additional support rods are similarly connected to the implosion protection band 50 at its other two comers, although this is not shown in the figures for simplicity.

Attached to the upper end of each of the support rods 58 and 60 (as well as to the two other support rods which are not shown in the figures) is a curved shield 54. Curved shield 54 is provided with the same curvilinear shape as the CRT's display screen 48*a* and is maintained in position in a spaced manner above the display screen by means of the four support rods. By matching the contour of the curved shield 54, which is preferably comprised of acrylate or other plastic material, to the contour of the CRTs display screen 48*a* and providing the shield with a size slightly larger in surface area than that of the display screen so that it extends beyond the lateral dimensions of the display screen, the shield forms a "dead" air space between the display screen and the shield to eliminate air turbulence above the display screen as it is rotated. This allows an antistatic and/or antireflective coating solution deposited on a center portion of the display screen 48*a* via a center aperture 54*a* in the shield to be distributed over the entire surface of the display screen in a generally uniform thickness as the CRT 48 is rotationally displaced. The spacing between the glass display screen 48*a* and shield 54, which is essentially uniform over the entire outer surface area of the display screen, is preferably 1–2 cm. Similarly, the aperture 54*a* within the curved shield 54 is preferably 1–2 cm in diameter. The ease with which shield 54 can be attached to and removed from the CRT's implosion protection band 50 allows the shield to be installed after the antistatic and/or antireflective coating is deposited on the CRT's display screen 48*a*, eliminating the need for aperture 54*a* within the shield for the deposit of the coating solution on the display screen.

There has thus been shown apparatus for the improved application of an antistatic and/or antireflective coating to the outer surface of a curved glass display screen of a CRT. The apparatus includes a curved shield having substantially the same contour as the CRT's display screen which is maintained in closely spaced relation above the display screen as the CRT is rotationally displaced after the antistatic and/or antireflective coating solution is deposited on a center portion of the display screen. The shield is easily attached to and removed from the CRT's implosion protection band disposed about the CRT's lateral periphery and is maintained approximately 1–2 cm above the CRT's display screen during the coating process. The shields forms a "dead" air space over the entire upper surface of the CRT's display screen to prevent the formation of air turbulence above the display screen and ensure the application of a coating of uniform thickness over the entire surface of the display screen.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration on and not as a limitation. The actual Scope of the invention is intended to be defined in the following claims when viewed in their proper perspective based on the prior art.

We claim:

1. Apparatus for applying an antistatic and/or antireflective coating of uniform thickness to the outer surface of a curvilinear glass display screen of a CRT following deposit of a solution of the antistatic and/or antireflective coating on a center portion of the display screen, said CRT including an implosion protection band disposed about the periphery thereof, said apparatus comprising:

rotary support means for engaging and rotationally displacing the CRT about its longitudinal axis with the display screen directed upwardly;

a curvilinear shield having a larger surface area than the display screen and substantially the same curvature as the display screen; and mounting means for attaching said shield to the CRT's implosion protection band and maintaining said shield in closely spaced relation to and above the display screen to avoid air turbulence above the display screen as the CRT is rotationally displaced for forming the coating with a substantially uniform thickness.

2. The apparatus of claim 1 wherein said shield is maintained 1–2 cm above the display screen.

3. The apparatus of claim 1 wherein said mounting means includes a plurality of support rods disposed in a spaced manner about and coupled to the CRT's implosion protection band.

4. The apparatus of claim 3 wherein the implosion protection band includes a plurality of ears each disposed on a respective corner thereof, and wherein each ear includes a respective aperture therein, with each support rod inserted through a respective aperture in an implosion protection band ear.

5. The apparatus of claim 4 wherein each support rod includes a threaded lower end and wherein said mounting means further includes first and second nuts disposed on the threaded lower end of each support rod and engaging a respective implosion protection band ear.

6. The apparatus of claim 5 wherein said shield includes an aperture in a center portion thereof for receiving the coating and permitting the coating to be deposited on a center portion of the display screen while said shield is attached to the CRT.

* * * * *

UNITED STATES PATENT AND TRADEMARK OFFICE

CERTIFICATE OF CORRECTION

PATENT NO. : 5,688,328

DATED : 11/18/97

INVENTOR(S) : Hua-Sou Tong et al.

It is certified that error appears in the above-indentified patent and that said Letters Patent is hereby corrected as shown below:

In column 3, line 67, "comers" should be -- corners --.

In column 4, lines 17 and 20, "comers" should be -- corners --.

Signed and Sealed this

Tenth Day of February, 1998

Bruce Lehman

*Attest:*

BRUCE LEHMAN

*Attesting Officer*

*Commissioner of Patents and Trademarks*